United States Patent [19]

Bandukwalla et al.

[11] Patent Number: 4,902,200

[45] Date of Patent: Feb. 20, 1990

[54] VARIABLE DIFFUSER WALL WITH RIBBED VANES

[75] Inventors: Phiroze Bandukwalla, Olean; Colin Osborne, Allegany, both of N.Y.

[73] Assignee: Dresser-Rand Company, Corning, N.Y.

[21] Appl. No.: 186,001

[22] Filed: Apr. 25, 1988

[51] Int. Cl.[4] ..... F01D 17/12

[52] U.S. Cl. ..... 415/148; 415/157; 415/914

[58] Field of Search ..... 415/46, 148, 150, 157, 415/206, 208.1, 208.2, 158, 208.3, 211.1, 211.2, 914

[56] References Cited

U.S. PATENT DOCUMENTS

| | | | |
|---|---|---|---|
| 481,074 | 8/1892 | Spencer | 415/158 |
| 1,047,663 | 12/1912 | Lawaczeck | 415/211 |
| 1,604,328 | 10/1926 | Walker | 415/148 |
| 2,739,782 | 3/1956 | White | 415/150 |
| 2,846,185 | 8/1958 | Widmer | 415/158 |
| 2,996,996 | 8/1961 | Jassniker | 415/148 |
| 3,032,259 | 5/1962 | Jassniker | 415/148 |
| 3,079,127 | 2/1963 | Rowlett et al. | 415/158 |
| 3,289,919 | 12/1966 | Wood | 415/150 |
| 3,362,624 | 1/1968 | Endress | 415/1 |
| 3,365,120 | 1/1968 | Jassniker | 415/158 |
| 3,588,270 | 6/1971 | Boelcs | 415/160 |
| 3,667,860 | 6/1972 | Endress et al. | 415/150 |
| 3,781,128 | 12/1973 | Bandukwalla | 415/211 |
| 3,784,318 | 1/1974 | Davis | 415/158 |
| 3,861,826 | 1/1975 | Dean, Jr. | 415/211 |
| 4,056,330 | 11/1977 | Lieber | 415/158 X |
| 4,070,132 | 1/1978 | Lynch | 415/48 |
| 4,156,581 | 5/1979 | Higuchi | 415/DIG. 1 |
| 4,218,182 | 8/1980 | Tsunoda et al. | 415/205 |
| 4,219,305 | 8/1980 | Mount et al. | 415/13 |
| 4,257,733 | 3/1981 | Bandukwalla et al. | 415/13 |
| 4,265,589 | 5/1981 | Watson et al. | 415/47 |
| 4,292,807 | 10/1981 | Rannenberg | 415/158 X |
| 4,308,718 | 1/1982 | Mowill | 415/DIG. 1 |
| 4,378,194 | 3/1983 | Bandukwalla | 415/49 |
| 4,395,197 | 7/1983 | Yoshinaga et al. | 415/211 |
| 4,403,914 | 9/1983 | Rogo et al. | 415/165 |
| 4,416,583 | 11/1983 | Byrns | 415/148 |
| 4,421,457 | 12/1983 | Yoshinaga et al. | 415/211 |
| 4,460,310 | 7/1984 | Plunkett | 415/26 |
| 4,470,256 | 9/1984 | Palmer | 415/150 X |
| 4,527,949 | 7/1985 | Kirtland | 415/150 |
| 4,544,325 | 10/1985 | Rogo et al. | 415/150 |
| 4,626,168 | 12/1986 | Osborne et al. | 415/211 |

FOREIGN PATENT DOCUMENTS

| | | | |
|---|---|---|---|
| 2135286 | 1/1973 | Fed. Rep. of Germany . | |
| 3028775 | 3/1981 | Fed. Rep. of Germany | 415/211 |
| 971224 | 1/1951 | France . | |
| 53-112907 | 10/1978 | Japan | 415/148 |
| 53-119411 | 10/1978 | Japan . | |
| 58-101299 | 6/1983 | Japan . | |
| 522343 | 9/1976 | U.S.S.R. . | |
| 823654 | 5/1981 | U.S.S.R. | 415/211 |

OTHER PUBLICATIONS

Turbomachinery Design Data Sheet No. 5, Turbomachinery Design Digest, published Aug., 1981, by D. Japiske.

Appendix E, Advanced Concepts in Turbomachinery, published Aug., 1981, Fluid Dynamics Institute, Hanover, New Hampshire.

*Primary Examiner*—Robert E. Garrett

*Assistant Examiner*—John T. Kwon

[57] ABSTRACT

An improved diffuser is provided for centrifugal compressors and the like. The diffuser has a movable wall to which is attached a plurality of ribbed vanes.

11 Claims, 3 Drawing Sheets

FIG. 4
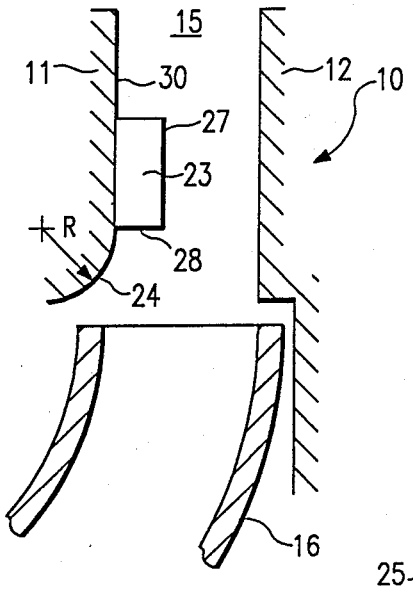
FIG. 5
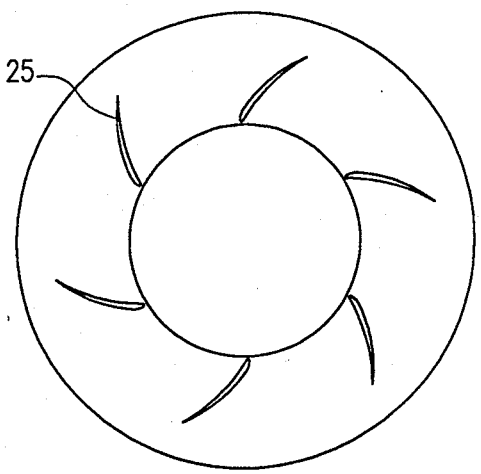
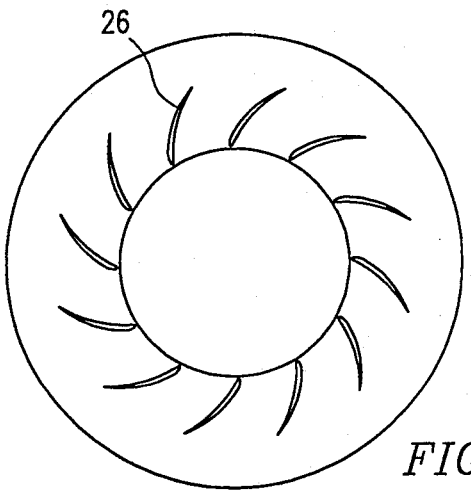
FIG. 6

VARIABLE DIFFUSER WALL WITH RIBBED VANES

FIELD OF THE INVENTION

This invention pertains to vaned diffuser and more particularly to a diffuser having ribbed vanes affixed to a movable wall.

BACKGROUND OF THE INVENTION

Diffusers for centrifugal compressors are generally characterized as having two confining walls known as the hub wall and the shroud wall. It is known that providing vanes in the diffuser can improve efficiency. Full vanes, or vanes which extend fully between the shroud wall and hub wall have been utilized. Slotted wall type diffusers where full vanes are accepted by slots in one of the walls are also known. Ribbed vanes, or vanes which do not extend fully between walls are known to be advantageous. They function by aligning boundary layer flow with the core flow so that the core flow is not disturbed at the design mass flow.

At partial mass flow, a fixed wall vaneless diffuser is less effective that at design mass flow, whereas a ribbed wall is more effective. Variable wall designs such as that seen in U.S. Pat. No. 3,365,120 issued Jan. 23, 1968 to Jassniker have been employed as solutions to the partial mass flow problem. Slotted wall designs using full vanes are effective but require elaborate mechanical hardware such as a precision slotted wall, anti-rotation device, elaborate sealing, springs to retain the vanes and a pocket behind the slots to contain flow leakage. Such a slotted wall mechanism is shown in U.S. Pat. No. 4,403,914 issued Sept. 13, 1983 to Rogo et al.

SUMMARY OF THE INVENTION

Mechanical complexity can be reduced while still obtaining significant range and efficiency improvements at partial load by utilizing the variable wall ribbed vane diffuser of the present invention.

Such a diffuser is characterized by a hub wall and a shroud wall, one of which is movable with respect to the other. Ribbed or partial height vanes are rigidly affixed to the movable wall. The ribs may extend the entire flow path of the diffuser or only a part of the flow path. Log spiral or circular arc straight line or air foil shaped ribs can be used.

BRIEF DESCRIPTION OF THE DRAWINGS

FIG. 4 shows in cross section the variable diffuser with ribbed vanes of the present invention. The device incorporates a pinched portion in the shroud wall and illustrates that ribbed vanes may extend to a full or partial diffuser wall radius.

FIG. 5 shows a front plan view of a diffuser with low solidity vanes.

FIG. 6 shows a front plan view of a diffuser with high solidity vanes.

DESCRIPTION OF THE PREFERRED EMBODIMENT

Figure 1:
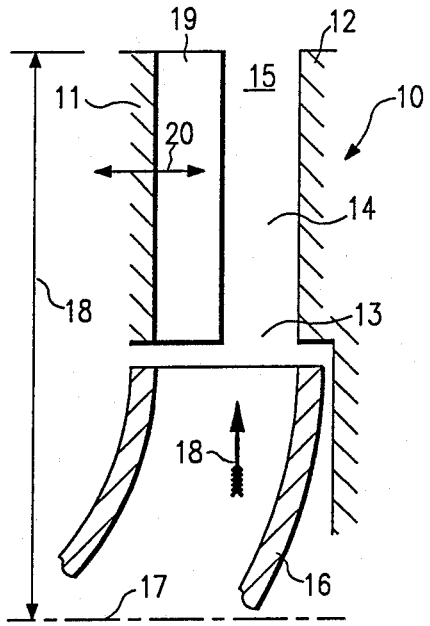
FIG. 1 shows in cross section the variable diffuser with ribbed vanes of the present invention. The ribbed vanes are attached to the movable shroud wall.
Figure 7:
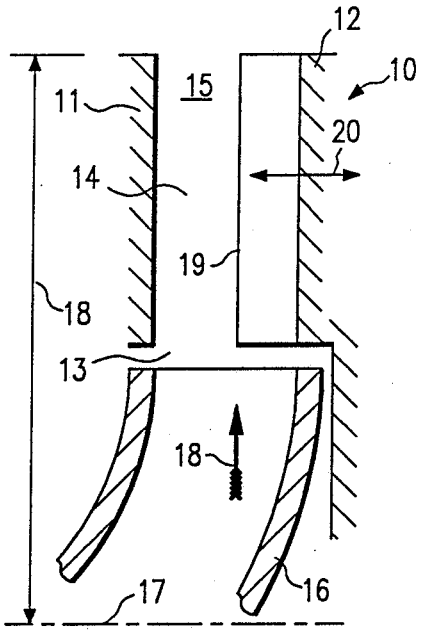
FIG. 7 shows in cross section the variable diffuser with ribbed vanes of the present invention. The ribbed vanes are attached to a movable hub wall.

FIGS. 1 and 7 illustrate an improved diffuser 10 of the present invention. The diffuser includes a shroud wall 11, a hub wall 12, an inlet 13, a flow path 14 and an outlet 15. An impeller 16 having a centerline 17 causes pressurized gas or fluid to enter the diffuser in the radial direction shown by the arrow 18. The distance from the centerline 17 of the impeller to the outlet 15 is referred to as the diffuser radius 18. In this example, ribbed vanes 19 extend from the inlet 13 to the outlet 15 and are therefore referred to as full radius ribbed vanes. The ribbed vanes extend no further than half the maximum separation between the hub wall and shroud wall. The shroud wall 11 having the ribbed vanes attached is capable of moving from an initial position, axially towards or away from the hub wall as shown by the arrow 20. Any of the prior art moving wall mechanisms may be employed. It is to be understood that the ribbed vanes may be in the form of log spiral type vanes or circular arc vanes, straight line or air foil-shaped vanes, as desired.

Figure 2:
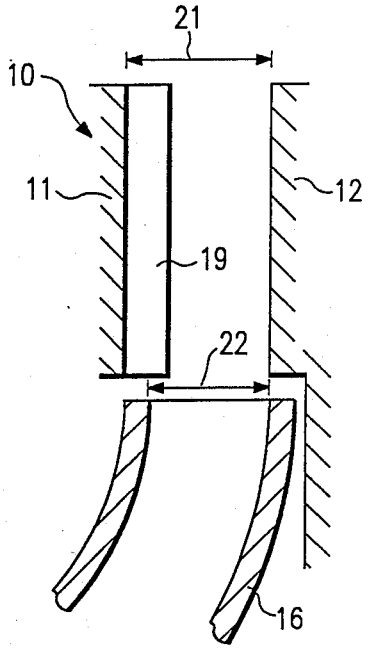
FIG. 2 shows in cross section the variable diffuser with ribbed vanes of the present invention. The ribbed vanes are attached to the movable shroud wall. The device is shown in an extended position.
Figure 9:
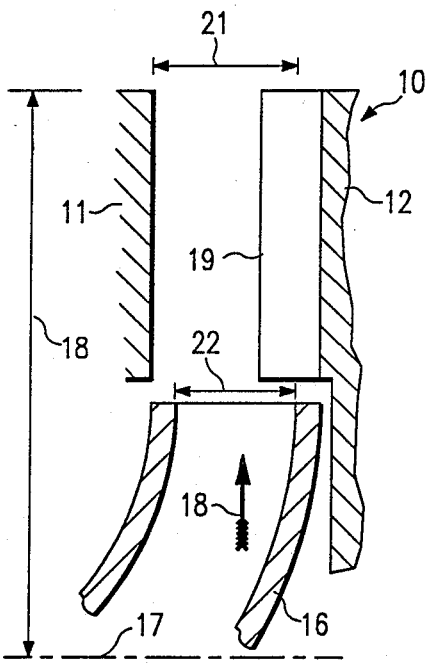
FIG. 9 shows in cross section the variable diffuser with ribbed vanes of the present invention. The ribbed vanes are attached to a movable hub wall. The device is shown in an extended position.

One of the benefits of the present invention is the capability of operating in an extended position as shown in FIGS. 2 and 9. In the extended position, the width 21 of the flow path of the diffuser is greater than the width 22 of the impeller discharge. This extend position is particularly useful during overload operation because the ribs are in a position to align boundary layer flow with the core flow, and because the diffuser can accept a greater mass flow without the expected proportional increase in frictional losses.

Figure 3:
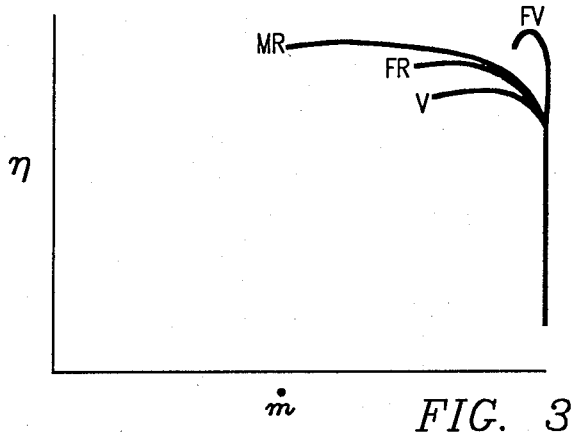
FIG. 3 is a graph depicting the effectiveness of the present invention.

The benefits of the invention are depicted in FIG. 3 where $\eta$ is the efficiency of the diffuser and where m is the mass flow (lbs./sec.). As depicted the performance of a diffuser of the present invention as shown by MR (movable rib) offers a greater range than a similar diffuser with either fixed full vanes as shown by FV, fixed ribbed vanes as shown by FR or vaneless as shown by V. Efficiency of the present invention is only bettered by the fixed vane design FV, but then only over a relatively narrow range.

Figure 8:
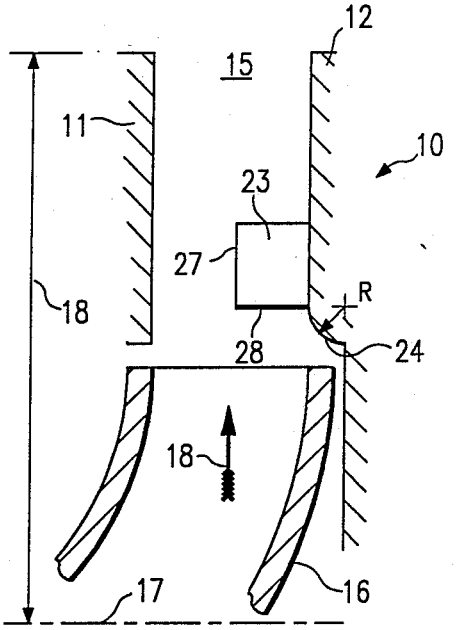
FIG. 8 shows in cross section the variable diffuser with ribbed vanes of the present invention. The device incorporates a pinched portion in the hub wall and illustrates that ribbed vanes may extend to a full or partial diffuser wall radius.

Several modifications to the present invention are suggested in FIGS. 4 and 8. It is to be understood that the various modifications may be practiced together or alone as required.

One modification is the provision of partial radius ribbed vanes 23. A ribbed vane of partial radius does not extend all the way to the diffuser outlet 15.

In addition or in the alternative, a pinched portion 24 having a pre-determined radius R can be incorporated into the shroud wall 11.

It will be understood that in designs incorporating a movable hub wall, the pinched portion or pre-determined radius will be incorporated into the hub wall. A pinched portion is useful when a reverse flow situation exists at the impeller exit.

While it is apparent that the invention of a variable diffuser wall having ribbed vanes, as disclosed herein is calculated to fulfill the objectives of increased range, efficiency and mechanical simplicity, it will be appreciated that numerous modifications may be devised. Accordingly this description is made only by way of example and should not be considered a limitation to the scope of the invention as set forth in the accompanying claims.

What is claimed is:

1. In a diffuser adapted to a centrifugal compressor, the diffuser having a hub wall and a shroud wall, the improvement comprising:

a shroud wall portion, movable with respect to the hub wall, the shroud wall having a plurality of ribbed vanes attached thereto; and the ribbed vanes extending no further than about half the maximum separation between the hub wall and shroud wall, whereby the efficiency of the diffuser is maximized over a larger volumetric flow range for partial-load rates.

2. The improved diffuser of claim 1 where: the ribbed vanes are full radius ribbed vanes.

3. The improved diffuser of claim 1 where: the ribbed vanes are partial radius ribbed vanes.

4. The improved diffuser of claim 1 where: the shroud wall is provided with a pinched portion.

5. The improved diffuser of claim 1, further including an impeller, and wherein the shroud wall is movable away from the hub wall to an extent such that the width of the flow path of the diffuser is greater than the width of the impeller.

6. In a diffuser adapted to a centrifugal compressor, the diffuser having a hub wall and a shroud wall, the improvement comprising:

a hub wall portion, movable with respect to the shroud wall, the hub wall having a plurality of ribbed vanes attached thereto; and the ribbed vanes extending no further than half the maximum separation between the hub wall and shroud wall, whereby the efficiency of the diffuser is maximized over a larger volumetric flow range for partial-load rates.

7. The improved diffuser of claim 6 where:

the ribbed vanes are full radius ribbed vanes.

8. The improved diffuser of claim 6 where:

the ribbed vanes are partial radius ribbed vanes.

9. The improved diffuser of claim 6 where:

the hub wall is provided with a pinched portion.

10. The improved diffuser of claim 6, further including an impeller, and wherein the hub wall is movable away from the shroud wall to an extent such that the width of the flow path of the diffuser is greater than the width of the impeller.

11. In a centrifugal compressor having an impeller forcing a fluid into a diffuser for achieving compression of the fluid, the improvement comprising:

a hub wall and a shroud wall defining a diffuser passage;

one said diffuser passage wall having a plurality of vanes fixed thereto; and means for axially moving said vaned diffuser passage wall with respect to the other wall, said wall moving means being adapted to move the vaned wall in one direction so that the vanes extend no further than about half the maximum separation between said hub wall and said shroud wall, and adapted to move the vaned wall in an opposite direction so that the width of the flow path of the diffuser passage is greater than the width of a discharge area of the impeller.

* * * * *